US011629725B2

(12) United States Patent
Chen et al.

(10) Patent No.: US 11,629,725 B2
(45) Date of Patent: Apr. 18, 2023

(54) CENTRIFUGAL HEAT DISSIPATION FAN

(71) Applicant: Acer Incorporated, New Taipei (TW)

(72) Inventors: Tsung-Ting Chen, New Taipei (TW); Wen-Neng Liao, New Taipei (TW); Cheng-Wen Hsieh, New Taipei (TW); Yu-Ming Lin, New Taipei (TW); Jau-Han Ke, New Taipei (TW); Kuang-Hua Lin, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 17/222,963

(22) Filed: Apr. 5, 2021

(65) Prior Publication Data

US 2021/0317839 A1 Oct. 14, 2021

(30) Foreign Application Priority Data

Apr. 13, 2020 (TW) ..... 109112338

(51) Int. Cl.
*F04D 29/28* (2006.01)
*F04D 17/08* (2006.01)
*F04D 29/42* (2006.01)

(52) U.S. Cl.
CPC ..... *F04D 29/281* (2013.01); *F04D 17/08* (2013.01); *F04D 29/4213* (2013.01)

(58) Field of Classification Search
CPC ... F04D 29/281; F04D 29/30; F05D 2240/307
See application file for complete search history.

(56) References Cited

U.S. PATENT DOCUMENTS 8,007,240 B2 * 8/2011 Sanagi ..... F04D 29/282 416/213 A
2008/0130226 A1 * 6/2008 Yamashita ..... F04D 29/30 415/203

FOREIGN PATENT DOCUMENTS

| | | | | |
|---|---|---|---|---|
| CN | 1802512 | | 7/2006 | |
| CN | 1966993 | | 5/2007 | |
| CN | 104033419 | B * | 8/2016 | |
| CN | 206346936 | | 7/2017 | |
| CN | 207920910 | | 9/2018 | |
| CN | 109751280 | | 5/2019 | |
| JP | 2008157216 | | 7/2008 | |
| TW | 200521333 | A * | 7/2005 | |
| TW | 200939938 | | 9/2009 | |
| TW | I487475 | | 6/2015 | |
| TW | I663339 | | 6/2019 | |
| WO | WO-9964746 | A1 * | 12/1999 | ..... F04D 29/023 |
| WO | WO-2012002107 | A1 * | 1/2012 | ..... B29C 53/02 |

* cited by examiner

*Primary Examiner* — Woody A Lee, Jr.
*Assistant Examiner* — Joshua R Beebe
(74) *Attorney, Agent, or Firm* — JCIPRNET

(57) ABSTRACT

A centrifugal heat dissipation fan including a housing and an impeller is provided. The housing has at least one flow inlet. The impeller assembled in the housing and rotating about an axial direction includes a hub and a plurality blades disposed around the hub. The flow inlet is located in the axial direction and faces the hub. Each of the blades has a wing tab next to the flow inlet, and the wing tab extends from a main surface of the blade to another blade. The wing tab has an inclined surface facing toward a periphery of the flow inlet along a radial direction of the impeller.

13 Claims, 7 Drawing Sheets

CENTRIFUGAL HEAT DISSIPATION FAN

CROSS-REFERENCE TO RELATED APPLICATION

This application claims the priority benefit of Taiwan application serial no. 109112338, filed on Apr. 13, 2020. The entirety of the above-mentioned patent application is hereby incorporated by reference herein and made a part of this specification.

BACKGROUND

Field of the Disclosure

The disclosure relates to a heat dissipation fan, and particularly to a centrifugal heat dissipation fan.

Description of Related Art

Generally speaking, in order to improve the heat dissipation effect in the notebook computer, the methods include nothing more than reducing the thermal resistance of the system or improving the performance of the heat dissipation fan disposed therein. However, since the appearance of notebook computer becomes thinner and lighter and excessive configuration of heat dissipation holes is unfavorable, there is a large thermal resistance in the system, which reduces the air intake of the heat dissipation fan, and the air from the outside cannot easily enter the system to generate heat circulation required for heat dissipation.

In the meantime, the air gap between the blades of existing centrifugal fan is large, so it is not easy to control the air flow and backflow is very likely to occur, therefore the wind pressure is insufficient, which affects the heat dissipation efficiency. In addition, once the flow inlet is increased to increase the air intake, if the blade does not provide a corresponding structure, it is also likely to cause air leakage.

Accordingly, in the case where the thermal resistance of the existing system already exists, it is bound to provide effective means for raising the wind pressure and quantity of input air for the heat dissipation fan to effectively solve the above-mentioned problems.

SUMMARY OF THE DISCLOSURE

The disclosure provides a centrifugal heat dissipation fan, of which the shape of blade corresponds to the flow inlet of the housing, thereby increasing the quantity of input air and wind pressure to improve its heat dissipation performance.

The centrifugal heat dissipation fan of the disclosure includes a housing and an impeller. The housing has at least one flow inlet. The impeller is rotatably assembled in the housing along an axial direction. The impeller has a hub and multiple blades arranged around the hub. The flow inlet is located in the axial direction and faces the hub. Each of the blades has a wing tab adjacent to the flow inlet, the wing tab extends from a main surface of the blade toward another adjacent blade, and the wing tab has an inclined surface that faces the periphery of the flow inlet along the radial direction of the impeller.

Based on the above, the centrifugal heat dissipation fan is provided with a wing tab near the flow inlet of the blade, and the wing tab has an inclined surface facing the periphery of the flow inlet. In this manner, the inclined surface of the wing tab can also cooperate with the flow inlet to form a guide structure that guides the airflow outside the housing into the housing. Therefore, the presence of the wing tab and its adaptability with the flow inlet can effectively increase the quantity of input air of the centrifugal heat dissipation fan. Moreover, since the bending direction of the wing tab extends toward another adjacent blade, for the entire impeller, these wing tabs will provide a shielding effect for the inside of the housing, that is, the airflow that has been sucked into the housing can be continuously kept in the housing to be pressurized until the airflow comes out from the flow outlet.

In other words, if the existing impeller is adopted to cooperate with the flow inlet that is expanded to achieve the effect of increasing the quantity of input air, the above-mentioned air leakage problem will occur accordingly, and the pressurizing effect on the airflow inside the housing is also limited. However, if the impeller of centrifugal heat dissipation fan in the disclosure is adopted instead, corresponding to the characteristic of the shape of wing tab of the above-mentioned blade, it is possible to achieve the effect of guiding the external airflow into the housing, and pressurizing can be effectively performed on the airflow inside the housing, thereby effectively preventing the occurrence of air leakage mentioned above, such that the operation efficiency of the centrifugal heat dissipation fan can be enhanced.

DESCRIPTION OF EMBODIMENTS

Figure 1:
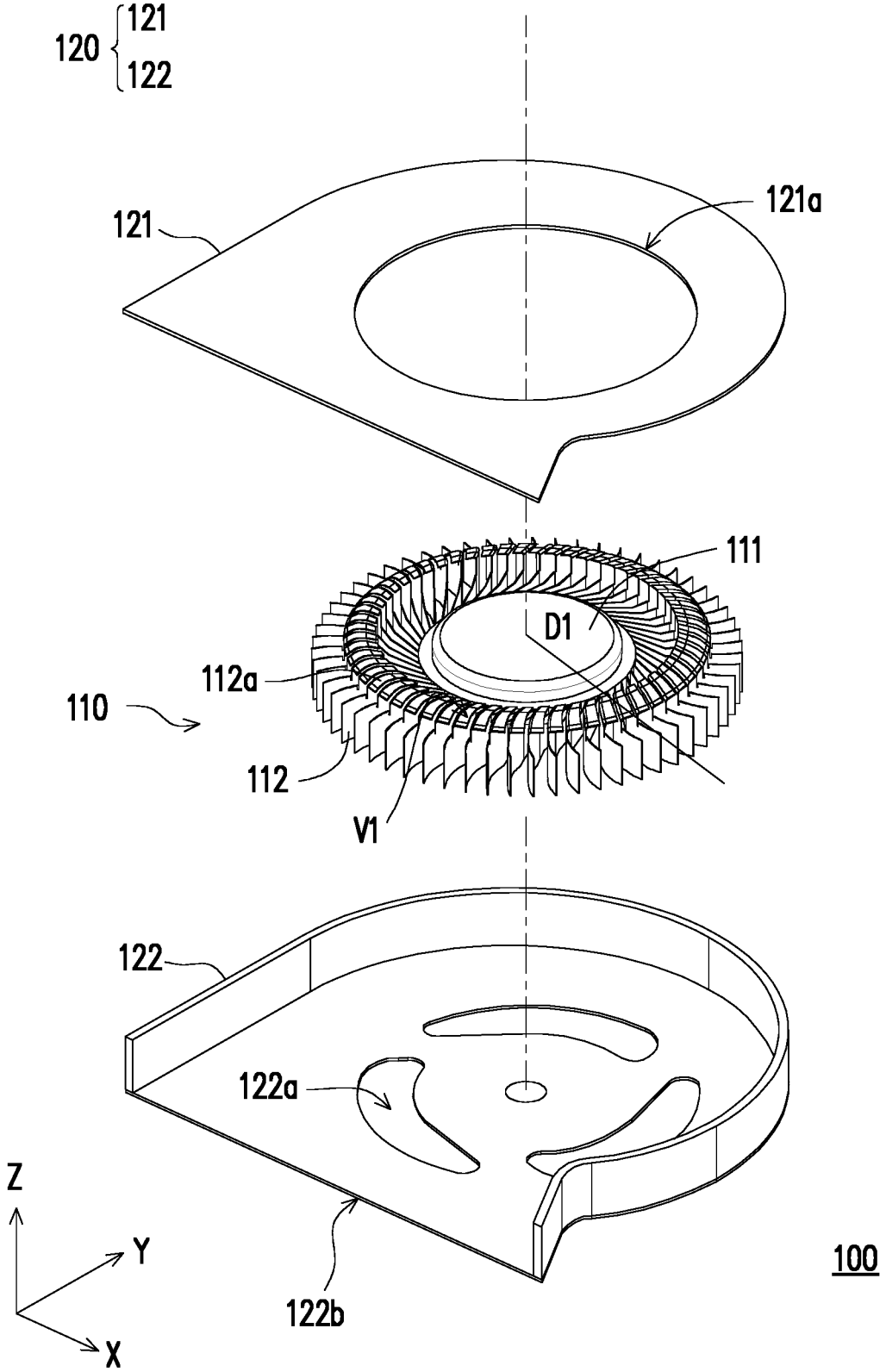
FIG. 1 is an exploded view of a centrifugal heat dissipation fan according to an embodiment of the disclosure.
Figure 2A:
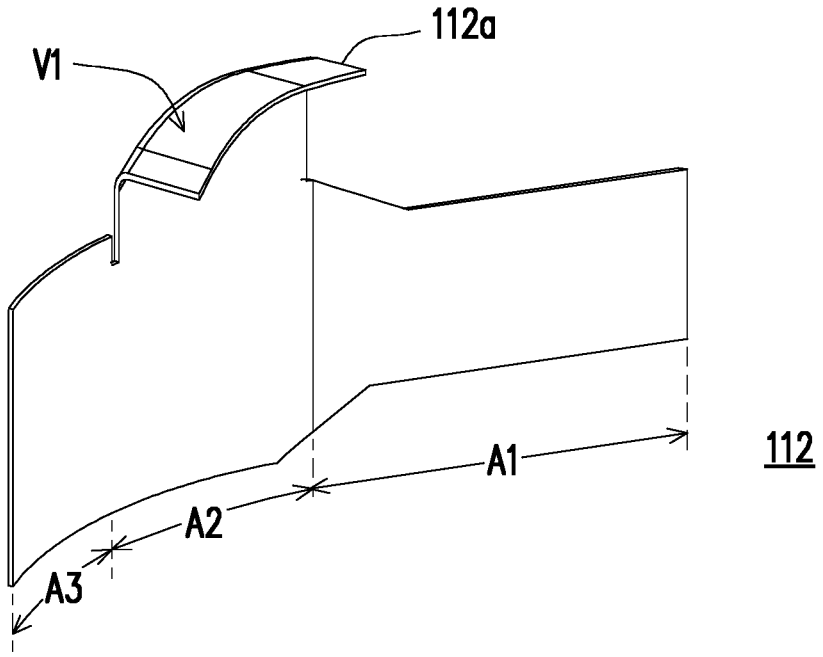
FIG. 2A is a perspective view of a blade of the centrifugal heat dissipation fan of FIG. 1.
Figure 2B:
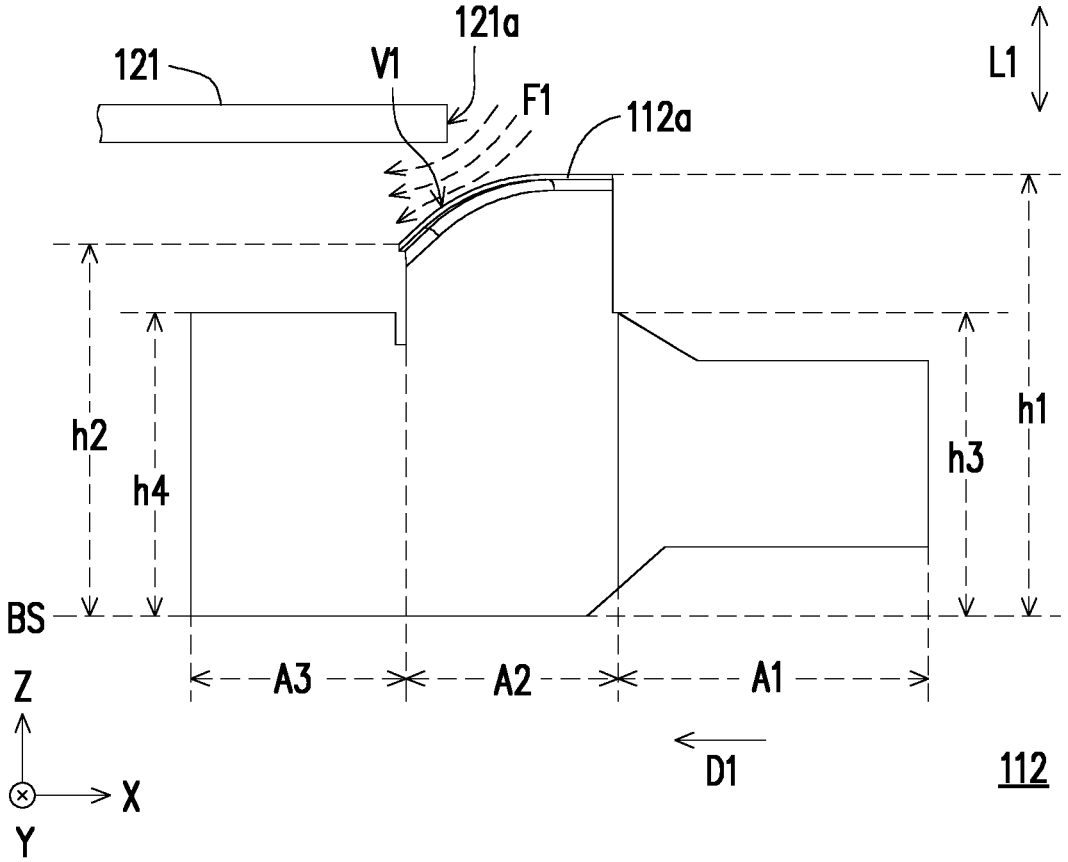
FIG. 2B is a partial side view of the centrifugal heat dissipation fan of FIG. 1.

FIG. 1 is an exploded view of a centrifugal heat dissipation fan according to an embodiment of the disclosure. FIG. 2A is a perspective view of a blade of the centrifugal heat dissipation fan of FIG. 1. FIG. 2B is a partial side view of the centrifugal heat dissipation fan of FIG. 1. In the meantime, the Cartesian coordinates X-Y-Z are provided to facilitate description of components. Please refer to FIG. 1, FIG. 2A and FIG. 2B at the same time. In the embodiment, the centrifugal heat dissipation fan 100 includes a housing 120 and an impeller 110. The housing 120 is composed of a base 122 and a top plate 121, and the housing 120 has flow inlets 122*a* and 121*a*. Here, the flow inlets 121*a* and 122*a* of the housing 120 respectively belong to the top plate 121 and the base 122, and the flow inlet 121*a* is the only one that cooperates with the impeller 110. Therefore, the flow inlet 121*a* will be the main object described subsequently, but the disclosure is not limited thereto. In another embodiment not shown, the impeller can also be designed in the manner that the shape of the blade corresponds to the flow inlet 122*a* to achieve the same effect as this embodiment. In other words, for the centrifugal heat dissipation fan 100, the operation mode thereof is that the airflow enters along the axial direction L1 and exits along the axial direction D1, which means that in the operation state of the impeller 110, the airflow outside the housing 120 enters the housing 120 through the flow inlets 121*a* and 122*a*, and exhausted from the housing 120 through the flow outlet 122*b* (composed of the combination of the top plate 121 and the base 122). Therefore, in this mode, the blades of the impeller cooperate with at least any one of the flow inlets to produce the same effect as this embodiment.

In this embodiment, the impeller 110 is rotatably assembled in the housing 120 along the axial direction L1, which is parallel to the Z-axis, and the impeller 110 has a hub 111 and multiple blades 112 arranged around the hub 111. The flow inlet 121*a* is located in the axial direction L1 and faces the hub 111. Each of the blades 112 has a wing tab 112*a* adjacent to the flow inlet 121*a*, the wing tab 112*a* extends from the main surface of the blade 112 toward another adjacent blade 112, and the wing tab 112*a* has an inclined surface V1, the inclined surface V1 faces the peripheral contour of the flow inlet 121*a* along the radial direction D1 of the impeller 110.

Figure 3:
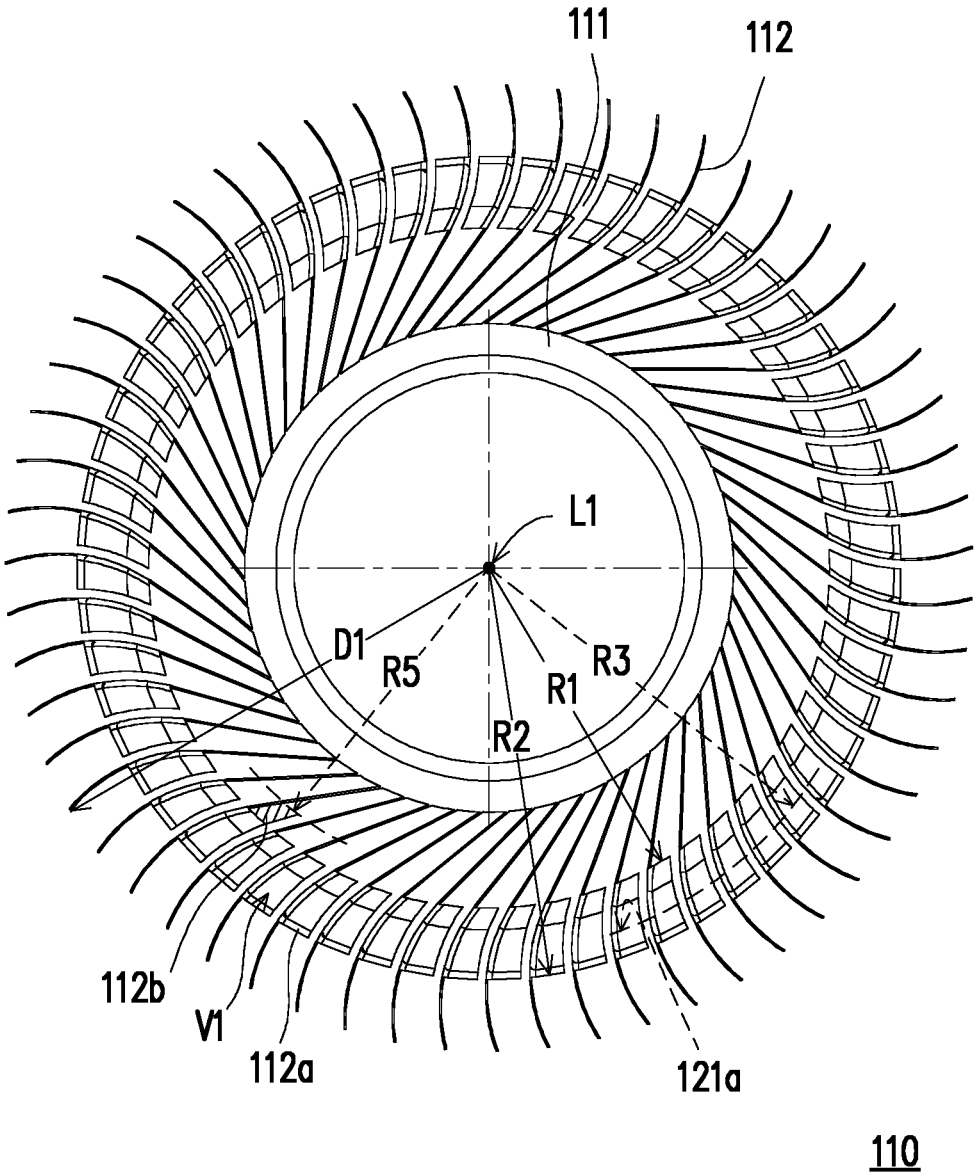
FIG. 3 is a top view of the blade of the centrifugal heat dissipation fan of FIG. 1.

FIG. 3 is a top view of the blade of the centrifugal heat dissipation fan of FIG. 1. Please refer to FIG. 2A, FIG. 2B and FIG. 3 at the same time. In this embodiment, the blade 112 is divided into a first area A1, a second area A2 and a third area A3 along the radial direction D1. The first area A1 is connected to the hub 111, the second area A2 is connected between the first area A1 and the third area A3. The wing tab 112*a* extends from the second area A2 and is bent relative to the main surface of the blade 112, and the preferred bending angle is 90 degrees. Here, the size of the second area A2 in the axial direction L1 is larger than the size of the first area A1 in the axial direction L1, and the size of the second area A2 in the axial direction L1 is larger than the size of the third area A3 in the axial direction L1. In other words, in terms of a single blade 112, the second area A2 where the wing tab 112*a* is located is in a higher state than the first area A1 and the third area A3 of the blade 112, which means that the blade 112 in the second area A2 has a larger main surface in size. This is also equivalent to that, compared to the existing blades of nearly equal-sized main surface, the wing tab 112*a* of the blade 112 in this embodiment should be substantially established in a part with a larger main surface so as to be easily close to the flow inlet 121*a*, that is, after making the partial main surface of the blade 112 expand in the axial direction L1, the wing tab 112*a* is formed thereon. FIG. 2B holds the pressure so that the airflow does not easily come out.

Further, in the overall view of the impeller 110 of this embodiment, multiple blades 112 are substantially located on the same plane BS, and the plane BS of this embodiment is parallel to the X-Y plane, and the aforementioned axial direction L1 becomes the normal of the plane BS. Under the circumstances, for the blades 112, the heights h1 and h2 of the top of the second area A2 relative to the plane BS are larger than the height h3 of the top of the first area A1 relative to the plane BS, and the heights h1 and h2 of the top of the second area A2 relative to the plane BS will also be larger than the height h4 of the top of the third area A3 relative to the plane BS, as shown in FIG. 2B. That is, as compared with the first area A1 and the third area A3, the second area A2 with the wing tab 112*a* is closer to the periphery of the flow inlet 121*a*, such that the airflow F1 outside the housing 120 can be smoothly guided into the housing 120 when the impeller 110 is operating due to the channel structure formed by the flow inlet 121*a* and the inclined surface V1 of the wing tab 112*a*.

Furthermore, in this embodiment, the height of the wing tab 112*a* relative to the plane BS gradually decreases along the radial direction D1. Please refer to FIG. 2B and FIG. 3 at the same time, with respect to the rotation center of the hub 111 (that is, the axial direction L1), the wing tab 112*a* has an outer diameter R2 and an inner diameter R1 in the radial direction D1 (here, the axial direction L1 is used as a reference, the radii of the wing tab 112*a* at both ends in the radial direction D1 are shown as an example), and the outer diameter R2 is larger than the inner diameter R1. Corresponding to FIG. 2, it can be clearly seen that the height h2 corresponding to the outer diameter R2 is smaller than the height h1 corresponding to the inner diameter R1, and gradually decreases from the inner diameter R1 to the outer diameter R2, wherein the inner diameter R1 is smaller than the radius R3 of the flow inlet 121*a*, and the radius R3 of the flow inlet 121*a* is smaller than the outer diameter R2 of the wing tab 112*a*, that is, a part of the wing tab 112*a* is covered by the top plate 121, the inclined surface V1 is formed in cooperation with the size described above, and the inclined surface V1 is designed to form a channel structure for guiding the airflow F1 with the flow inlet 121*a*. Moreover, since the wing tab 112*a* and the flow inlet 121*a* have the above-mentioned corresponding relationship, the centrifugal heat dissipation fan 100 can prevent the airflow in the housing 120 from leaking, and has the effect of maintaining the wind pressure.

Figure 4A:
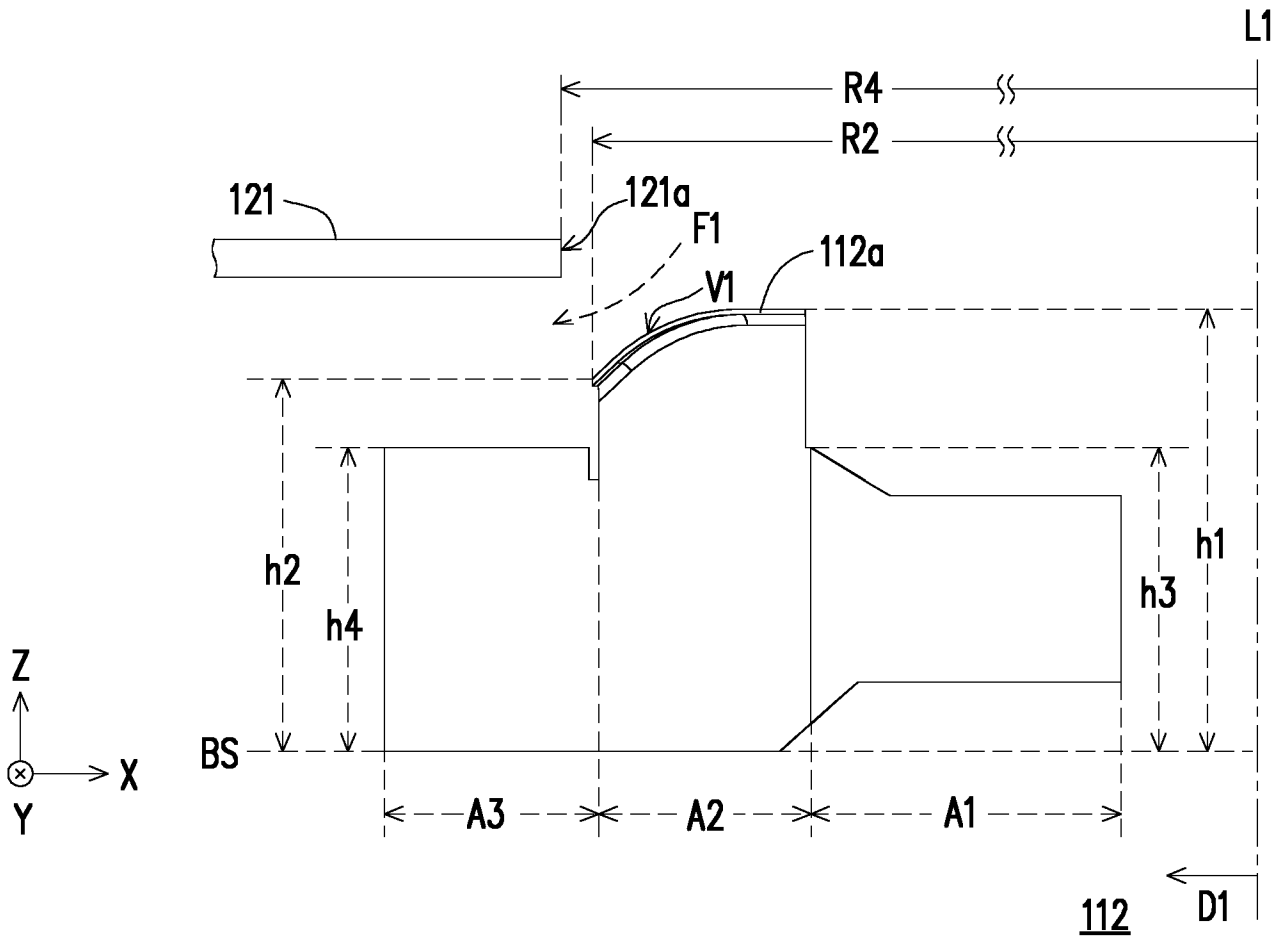
FIG. 4A and FIG. 4B are partial side views of centrifugal heat dissipation fans according to different embodiments of the disclosure.
Figure 4B:
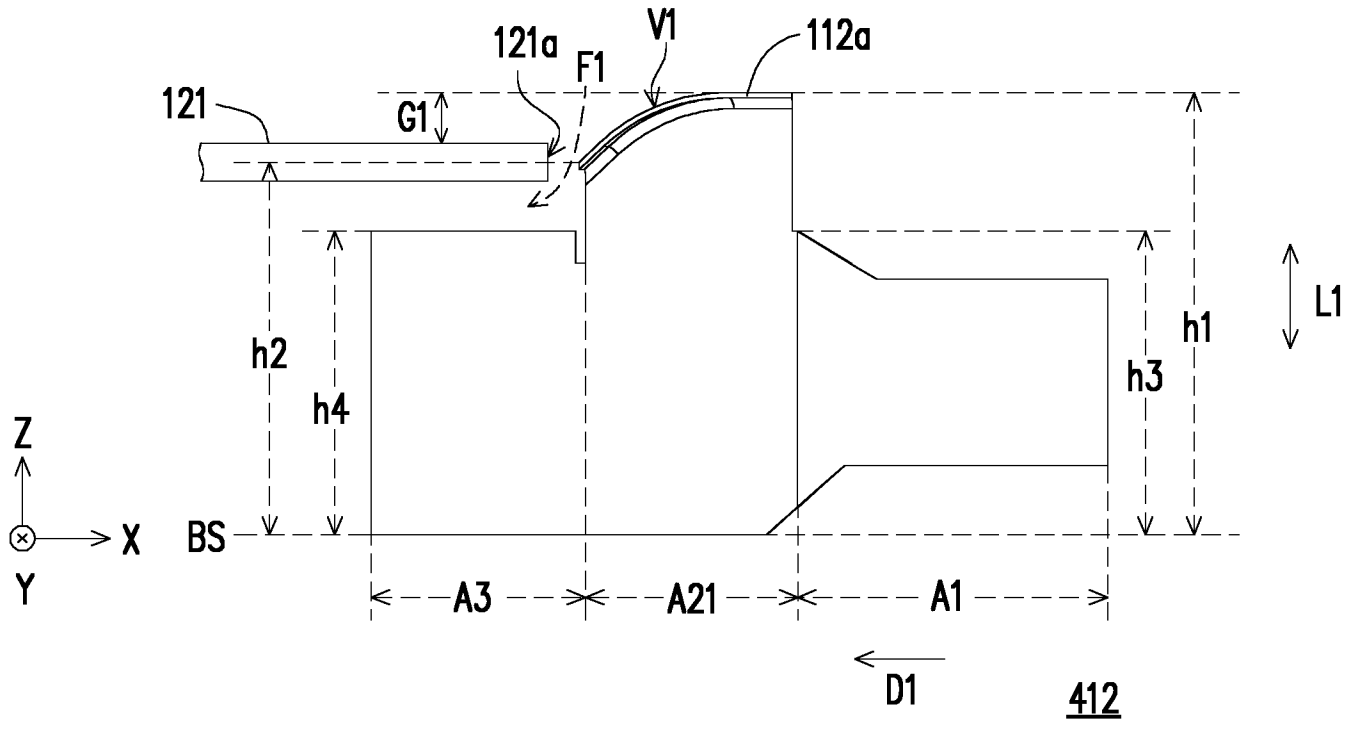

FIG. 4A and FIG. 4B are partial side views of centrifugal heat dissipation fans according to different embodiments of the disclosure. Please refer to FIG. 4A first. Different from the previous embodiment, the outer diameter R2 of the wing tab 112*a* is smaller than the radius R4 of the flow inlet 121*a*, that is, the wing tab 112*a* is completely exposed from the flow inlet 121*a*, but the flow inlet 121*a* along with the inclined surface V1 of the wing tab 112*a* still form a contour that is gradually decreased from the outer part of the housing 120 toward the inner part of the housing 120. Therefore, at the flow outlet 122*b* (shown in FIG. 1) of the housing 120 or a position adjacent thereto, since the airflow inside the housing 120 is exhausted, the airflow F1 on the outside can be smoothly guided into the housing 120 through the flow inlet 121*a*, thereby increasing the quantity of input air of the centrifugal heat dissipation fan 100.

Please refer to FIG. 4B, which is different from the previous embodiment in that the height of the wing tab 112*a* relative to the plane BS is larger than the height of the flow inlet 121*a* relative to the plane BS, as shown in the figure. There is a protruding gap G1 at the wing tab 112*a* relative to the top plate 121, and such configuration can further increase the quantity of input air and wind pressure. In other words, the blade 412 of this embodiment allows the second area A21 to further expand the main surface along the axial direction L1, so that the wing tab 112*a* can protrude from the flow inlet 121*a*. However, the same as the previous embodiment, the inclined surface V1 of the wing tab 112*a* can still correspond to the periphery of the flow inlet 121*a* to form a tapered contour, which is also advantageous for guiding the external airflow F1 of the housing 120 into the housing 120.

Based on the above embodiments, in general, the impeller 110 of the disclosure expands along the axial direction L1 in the second area A2 or A21 of its main surface 112 or 412, such that the wing tap 112*a* thereon can be adjacent to the flow inlet 121*a*, and thus the inclined surface V1 of the wing tab 112*a* can be close to the periphery of the flow inlet 121*a* to form a tapered contour, thereby increasing the quantity of input air and wind pressure of the centrifugal heat dissipation fan 100. Meanwhile, the wing tab 112*a* has the outer diameter R2 and the inner diameter R1 along the radial direction D1, which allows the designer to make adjustment to the desired quantity of input air and wind pressure. Here, the quantity of input air of the centrifugal heat dissipation fan 100 is proportional to the inner diameter R1, and the wind pressure of the centrifugal heat dissipation fan 100 is inversely proportional to the inner diameter R1. Briefly, please refer to FIG. 3, the smaller the inner diameter R1 of the wing tab 112*a*, the larger the radial size of the wing tab 112*a*, as the inner diameter R5 shown in the figure, and which is equivalent to adding the area shown by diagonal lines. For the internal space of the housing 120, the wing tag 112*b* formed as described above can be seen as increasing the area covering the internal space, and also improving the retention rate of the airflow in the internal space, so that the wind pressure of the centrifugal heat dissipation fan 100 can be improved.

In the centrifugal heat dissipation fan 100 of this embodiment, the diameter of the flow inlet 121*a* is smaller than the diameter of the impeller 110, and based on the example that the diameter of the flow inlet 121*a* is 80% of the diameter of the impeller 110, if the impeller of existing technology is adopted, when the flow inlet is further enlarged to increase the quantity of input air, the blade of the impeller cannot cooperate with the above configuration and thus the problem the air leakage will occur. On the contrary, if the impeller 110 in the above-mentioned embodiment of the disclosure is adopted, that is, the blade 112 or 412 has the wing tab 112*a*, it is possible to further reduce the distance between the impeller 110 and the housing 120 at the flow inlet 121*a*. In other words, the impeller 110 of the disclosure, with the configuration of the wing tab 112*a* on the blade 112 or 412, changes the original fixed shielding structure (the local substance of the top plate 121 at the periphery of the flow inlet 121*a*) into a movable shielding structure (i.e., wing tab 112*a*), thereby expanding the flow inlet to increase the quantity of input air while improving the required wind pressure. Similarly, even without enlarging the flow inlet, the blade 112 with the wing tab 112*a* can achieve the effect of increasing the quantity of input air and wind pressure.

Figure 5A:
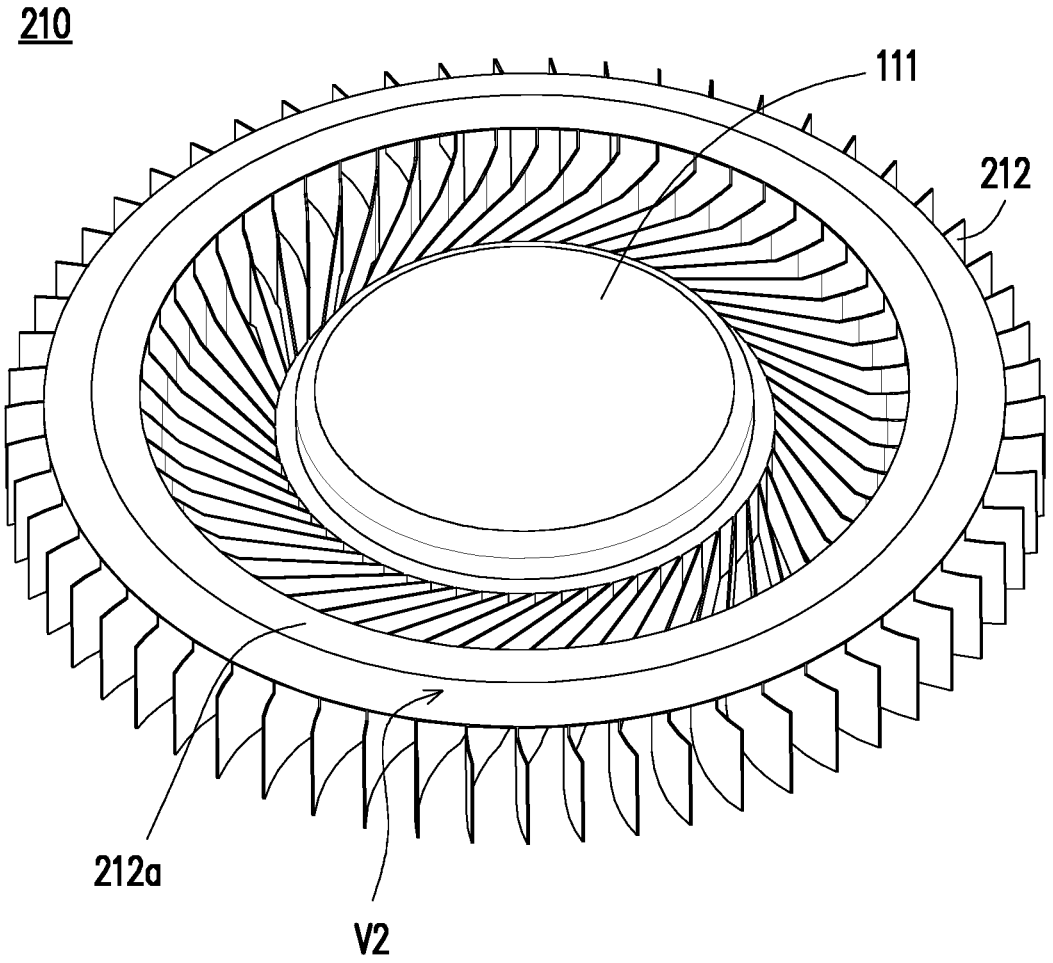
FIG. 5A is a schematic view of a centrifugal heat dissipation fan according to another embodiment of the disclosure.
Figure 5B:
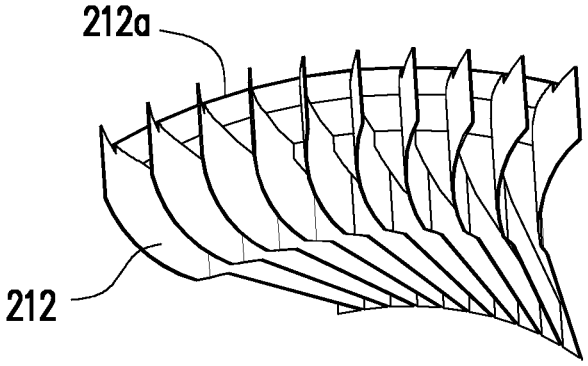
FIG. 5B illustrates a part of the centrifugal heat dissipation fan of FIG. 5A from another viewing angle.

FIG. 5A is a schematic view of a centrifugal heat dissipation fan according to another embodiment of the disclosure. FIG. 5B illustrates a part of the centrifugal heat dissipation fan of FIG. 5A from another viewing angle. Please refer to FIG. 5A and FIG. 5B at the same time. In the impeller 210 of this embodiment, the wing tab 212*a* of each blade 212 extends from the main surface of the blade 212 toward another adjacent blade 212 and is connected to another wing tab 212*a* of another blade 212, so that the wing tabs 212*a* of the impeller 210 are connected to each other in a ring shape, and the wing tabs 212*a* arranged in ring shape also have an inclined surface V2 to correspond to the flow inlet 121*a* (shown in FIG. 1) facing the housing 120, such that the impeller 210 can effectively improve its structural strength while achieving the same effect as the previous embodiment. The disclosure provides no limitation to the connection manner of the wing tab 212*a*, which may be fastened one by one by the fasteners formed by the metal blades in the stamping process, or by connecting the blades 212 through plastic materials by injection in the mold. Certainly, the blade 212 and its wing tab 212*a* can also be completed by one-time injection molding through plastic materials.

Figure 6:
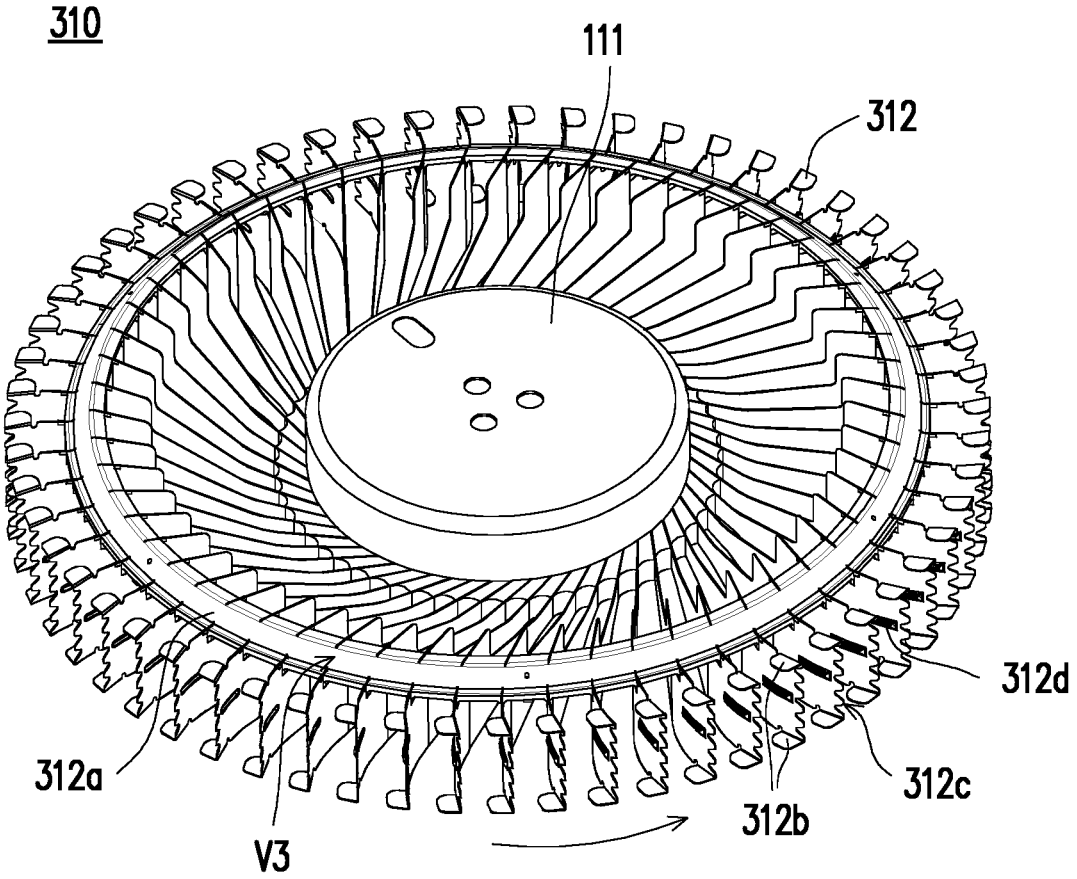
FIG. 6 is a schematic view of a centrifugal heat dissipation fan according to another embodiment of the disclosure.

FIG. 6 is a schematic view of a centrifugal heat dissipation fan according to another embodiment of the disclosure. Referring to FIG. 6, in the impeller 310 of this embodiment, the blade 312 disposed at the hub 111 already has the relevant features described in the previous embodiment, for example, the wing tabs 312*a* adjacent to each other are connected together and form a ring shape, and is equally provided with an inclined surface V3 corresponding to the flow inlet 121*a*. The difference lies in that the blade 312 of this embodiment also has a broken blade edge 312*c* and another wing tab 312*b*, wherein the broken blade edge 312*c* is substantially located in the third area A3 of the blade 312 (as shown in FIG. 2A and FIG. 2B). The wing tab 312*b* and the broken blade edge 312*c* are respectively at different edges of the third area A3 (the broken blade edge 312*c* is adjacently connected between a pair of wing tabs 312*b*), wherein the wing tab 312*b* has a swept-back design with respect to the rotation direction (see counterclockwise arrow as shown in the figure) of the impeller 310. Here, the blade 312, the broken blade edge 312*c*, and the wing tab 312*b* are formed by stamping and bending a metal plate. Accordingly, not only that the blade 312 of this embodiment retains the features and effects of the previous embodiment, the wing tab 312*b* and the broken blade edge 312*c* can further disperse and weaken the vortex formed at the end of the blade 312, so as to reduce the disturbance caused by the rotation of the blade 312 to the surrounding air, thereby achieving the effects of improving operation efficiency and reducing noise.

In summary, in the above embodiments of the disclosure, the centrifugal heat dissipation fan is provided with a wing tab near the flow inlet of the blade, and the wing tab has an inclined surface facing the periphery of the flow inlet. In this manner, the inclined surface of the wing tab can also cooperate with the flow inlet to form a guide structure that guides the airflow outside the housing into the housing, so the presence of the wing tab and its adaptability to the flow inlet can effectively improve the quantity of input air of the centrifugal heat dissipation fan. In the meantime, because the bending direction of the wing tab extends toward another adjacent blade, for the entire impeller, these wing tabs will provide a shielding effect on the inside of the housing, that is, the airflow that has been sucked into the housing can be continuously kept in the housing to be pressurized until it comes out from the flow outlet. In addition, the designer can adjust the inner diameter and outer diameter of the wing tab and the height of the wing tab relative to the plane where the blade is located depending on different needs for the quantity of input air and wind pressure.

In other words, if the existing impeller is adopted to cooperate with the flow inlet that is expanded to achieve the effect of increasing the quantity of input air, the above-mentioned air leakage problem will occur accordingly, and the pressurizing effect on the airflow inside the housing is also limited. However, if the impeller of centrifugal heat dissipation fan in the disclosure is adopted instead, corresponding to the characteristic of the shape of wing tab of the above-mentioned blade, it is possible to achieve the effect of guiding the external airflow into the housing, and pressurizing can be effectively performed on the airflow inside the housing, thereby effectively preventing the occurrence of air leakage mentioned above, such that the operation efficiency of the centrifugal heat dissipation fan can be enhanced.

What is claimed is:

1. A centrifugal heat dissipation fan, comprising:

a housing having at least one flow inlet; and an impeller rotatably assembled in the housing along an axial direction, wherein the impeller has a hub and multiple blades arranged around the hub, the flow inlet is located in the axial direction and faces the hub, each of the blades has a wing tab adjacent to the flow inlet, the wing tab extends from a top edge of a main surface of the blade toward another adjacent blade, wherein the wing tab has a curved surface, a height of the curved surface relative to a bottom edge of the main surface of the blade decreases along a radial direction of the impeller, and a portion of the curved surface faces toward a periphery edge of the flow inlet, wherein the top edge and the bottom edge are two opposite edges of the main surface of the blade along the axial direction.

2. The centrifugal heat dissipation fan according to claim 1, wherein the diameter of the flow inlet is smaller than the diameter of the impeller.

3. The centrifugal heat dissipation fan according to claim 1, wherein the blade is divided into a first area, a second area and a third area along the radial direction, the first area is connected to the hub, the second area is connected between the first area and the third area A3, and the wing tab extends from the second area.

4. The centrifugal heat dissipation fan according to claim 3, wherein the size of the second area in the axial direction is larger than the size of the first area in the axial direction, and the size of the second area in the axial direction is larger than the size of the third area in the axial direction.

5. The centrifugal heat dissipation fan according to claim 3, wherein the blades are located on the same plane, the height of a top of the second area relative to the plane is larger than the height of a top of the first area relative to the plane, and the height of the top of the second area relative to the plane is larger than the height of a top of the third area relative to the plane.

6. The centrifugal heat dissipation fan according to claim 5, wherein the height of the wing tab relative to the plane decreases along the radial direction.

7. The centrifugal heat dissipation fan according to claim 5, wherein the height of the wing tab relative to the plane is larger than the height of the flow inlet relative to the plane.

8. The centrifugal heat dissipation fan according to claim 3, wherein one end of the third area away from the hub further has a broken blade edge.

9. The centrifugal heat dissipation fan according to claim 8, wherein the third area further has at least one other wing tab, and the other wing tab and the broken blade edge are respectively at different edges of the third area, the other wing tab is of a swept-back design with respect to a rotation direction of the impeller.

10. The centrifugal heat dissipation fan according to claim 1, wherein the wing tab has an outer diameter and an inner diameter along the radial direction, the outer diameter is larger than the inner diameter, the inner diameter is smaller than the radius of the flow inlet, and the radius of the flow inlet is smaller than the outer diameter.

11. The centrifugal heat dissipation fan according to claim 1, wherein the wing tab has an outer diameter and an inner diameter along the radial direction, the outer diameter is larger than the inner diameter, and the outer diameter is smaller than the radius of the flow inlet.

12. The centrifugal heat dissipation fan according to claim 1, wherein the wing tab has an outer diameter and an inner diameter along the radial direction, the outer diameter is larger than the inner diameter, and the quantity of input air of the centrifugal heat dissipation fan is proportional to the inner diameter, and a wind pressure of the centrifugal heat dissipation fan is inversely proportional to the inner diameter.

13. The centrifugal heat dissipation fan according to claim 1, wherein the wing tab extends from the main surface of the blade toward another adjacent blade and is connected to another wing tab of said another blade, such that the wing tabs of the impeller are connected to each other in a ring shape.

* * * * *